US010215379B2

(12) United States Patent
Dix

(10) Patent No.: US 10,215,379 B2
(45) Date of Patent: Feb. 26, 2019

(54) LIGHTING SYSTEM

(71) Applicants: Dietmar Dix, Essen (DE); Heike Bedoian, Siegen (DE)

(72) Inventor: Dietmar Dix, Essen (DE)

(73) Assignees: Dietmar Dix, Essen (DE); Heike Bedoian, Siegen (DE)

( * ) Notice: Subject to any disclaimer, the term of this patent is extended or adjusted under 35 U.S.C. 154(b) by 263 days.

(21) Appl. No.: 15/124,419

(22) PCT Filed: Mar. 11, 2015

(86) PCT No.: PCT/EP2015/055041
§ 371 (c)(1),
(2) Date: Sep. 8, 2016

(87) PCT Pub. No.: WO2015/135973
PCT Pub. Date: Sep. 17, 2015

(65) Prior Publication Data

US 2017/0030561 A1 Feb. 2, 2017

(30) Foreign Application Priority Data

Mar. 12, 2014 (DE) ..... 10 2014 003 251
Mar. 12, 2014 (DE) ..... 20 2014 104 847 U

(51) Int. Cl.
*F21V 23/06* (2006.01)
*F21V 21/005* (2006.01)
(Continued)

(52) U.S. Cl.
CPC ..... *F21V 21/005* (2013.01); *F21S 2/005* (2013.01); *F21S 4/28* (2016.01); *F21V 21/28* (2013.01);
(Continued)

(58) Field of Classification Search
CPC ..... F21V 23/06; F21V 19/0005; F21V 21/30; F21V 19/00; F21V 17/04
(Continued)

(56) References Cited

U.S. PATENT DOCUMENTS 3,840,842 A 10/1974 Gabryelewicz
7,322,735 B1 * 1/2008 Caldani ..... F21V 21/22 362/285
(Continued)

FOREIGN PATENT DOCUMENTS

DE 3446045 A1 6/1986
EP 2551585 A1 7/2011
(Continued)

*Primary Examiner* — William J Carter
(74) *Attorney, Agent, or Firm* — Rankin, Hill & Clark LLP

(57) ABSTRACT

A lighting system having at least one lighting unit including a light segment for receiving at least one lamp, at least one connecting element that at least in sections is electrically conductive and at one end of the light segment is mechanically and electrically connected thereto, and at least one connector, which has at least one element circumferentially surrounding a connector middle axis and at least one electrical conductor mechanically connected to or formed by the circumferential element. The connecting element is mechanically connected to the circumferential element of the connector and thereby the at least one lighting unit is mechanically and electrically connected to the connector. The lighting system can be arranged in various positions around the connector middle axis and in every position the lighting unit is mechanically and electrically connected to the connector. Several lighting units can be connected to a common connector.

37 Claims, 7 Drawing Sheets

(51) Int. Cl.

| | |
|---|---|
| ***F21S 2/00*** | (2016.01) |
| ***F21V 21/30*** | (2006.01) |
| ***F21S 4/28*** | (2016.01) |
| ***F21V 21/28*** | (2006.01) |
| *F21Y 103/10* | (2016.01) |
| *F21Y 115/10* | (2016.01) |
| *F21S 8/00* | (2006.01) |
| *F21S 8/06* | (2006.01) |
| *F21V 17/10* | (2006.01) |

(52) U.S. Cl.
CPC ..... *F21V 21/30* (2013.01); *F21V 23/06* (2013.01); *F21S 8/038* (2013.01); *F21S 8/066* (2013.01); *F21V 17/10* (2013.01); *F21Y 2103/10* (2016.08); *F21Y 2115/10* (2016.08)

(58) Field of Classification Search
USPC ..... 362/648–659
See application file for complete search history.

(56) References Cited

U.S. PATENT DOCUMENTS

| | | | | |
|---|---|---|---|---|
| 7,654,834 | B1 | 2/2010 | Mier-Langner et al. | |
| 7,758,358 | B1 * | 7/2010 | Mier-Langner ..... | H01R 25/142 362/219 |
| 8,628,212 | B2 * | 1/2014 | Klus' ..... | F21S 8/02 362/217.01 |
| 2007/0153550 | A1 | 7/2007 | Lehmann et al. | |
| 2009/0135602 | A1 | 5/2009 | Liu et al. | |
| 2012/0294004 | A1 | 11/2012 | Stathis et al. | |

FOREIGN PATENT DOCUMENTS

| | | | |
|---|---|---|---|
| GB | 2481850 | A | 1/2012 |
| WO | 2012158723 | A1 | 11/2012 |
| WO | 2014035002 | A1 | 3/2014 |

* cited by examiner

LIGHTING SYSTEM

The present invention relates to a lighting system with at least one lighting unit comprising a light segment which is configured for receiving at least one lamp or comprises at least one lamp, and at least one connecting element that at least in sections is electrically conductive and at one end of the lighting segment is mechanically and electrically connected thereto, with at least one connector, which has at least one element circumferentially surrounding a connector middle axis (hereinafter simply referred to as middle axis) and at least one electrical conductor mechanically connected to or formed by the circumferential element, wherein the connecting element of the lighting unit is mechanically connected to the circumferential element of the connector and through this the at least one lighting unit is mechanically and electrically connected to the connector.

The present invention relates in particular to a lighting system with elements (lighting units, in particular tracks), which can receive lamps or can produce light, and nodal points (hereinafter also referred to as connectors or connecting modules) to which one or more of these elements or lighting units can be connected. The lighting units can be easily applied to the connectors. The angles at which the lighting units can be mounted on the connectors are largely freely selectable. Optional joints, in particular hinges, ensure that the lighting units can be pivoted. The lighting units convey current from one nodal point (connector) to the next one. The connectors convey current from one lighting unit to the next.

There are many track systems available which in general can be attached to ceilings, let into ceilings or suspended from ceilings.

The angles at which the track elements are arranged with regard to each other are generally 90° or 180°. In U.S. Pat. No. 3,840,842 a nodal point is described to which elements that can receive lamps can also be mounted at an angle of 45° or 135°. In WO 2013/070429 A1 connectors are also described to which up to 8 longitudinal elements can be attached at angles of 45°, 90°, 135° and 180°.

According to the orientation of the lighting systems on the ceiling, it is in general linear structures (lighting strips) or two-dimensional structures that are made possible with the known track systems. An exception is WO 2006/044859 A1 which describes how lighting elements can be attached at predetermined angles—not just horizontally—to connecting elements. Furthermore, US 2012/0201021 A1 describes connecting elements into which lighting rods can not only be attached horizontally at an angle of 90° and 180°, but also vertically.

If the known track systems have connectors (connecting modules), often not inconsiderable assembly cost and effort is associated with connecting the lighting units to the connectors.

The design possibilities using known track lighting systems are very limited as on the one hand they are often only linearly or two-dimensionally configurable, or, on the other hand can only be configured at certain predefined angles. Structures that grow upwards on wall like plants our go around corners are just as impossible as polyhedral lights or trussed or supporting structure constructions.

One object of the present invention is therefore to reduce the assembly work in the case of a lighting system.

According to a first teaching of the present invention, the previously derived and indicated object is achieved in a lighting system with at least one lighting unit (in particular a track, i.e. an longitudinal lighting unit), comprising a lighting segment (lighting element) which is configured for receiving at least one lamp or comprises at least one lamp, and at least one connecting element (more particularly an element connectable to another component, e.g. plug/socket) which at least in sections is electrically conductive and at one end of the light segment is mechanically and electrically connected thereto, with at least one connector which has at least one element circumferentially surrounding a connector middle axis (i.e. designed circumferentially) and at least one electrical conductor mechanically connected to the circumferential element or formed by the circumferential element, wherein the connecting element of the lighting unit is mechanically connected to the circumferential element of the connector and thereby the as least one lighting element is mechanically and electrically connected to the connector, in that with the connector the lighting unit can be arranged in various positions around the connector middle axis (i.e. in various angular positions or positions around the circumference) and in each position the lighting element is mechanically and electrically connected to the connector, and several lighting units are mechanically and electrically connected to a joint connector and, in particular, form a two-dimensional or three-dimensional light system.

According to a second teaching of the present invention the object is achieved in the case of a lighting system, in particular a lighting system as described above with at least one lighting unit (in particular a track) comprising a lighting segment (lighting element) which is configured for receiving at least one lamp or comprises at least one lamp, and at least one connecting element (more particularly an element connectable to another component) which at least in sections is electrically conductive and at one end of the light segment is mechanically and electrically connected thereto, with at least one connector which has at least one element circumferentially surrounding a connector middle axis (i.e. designed circumferentially) and at least one electrical conductor mechanically connected to the circumferential element or formed by the circumferential element, wherein the connecting element of the lighting unit is mechanically connected to the circumferential element of the connector and thereby the as least one lighting element is mechanically and electrically connected to the connector, in that with the connector the lighting unit can be arranged in various positions around the connector middle axis an in every position the lighting unit is mechanically and electrically connected to the connector and several connectors with a common lighting unit are mechanically and electrically connected and, in particular, for a two-dimensional or three-dimensional lighting system.

The lighting system according to the invention is characterised in that it can be easily and rapidly installed, even when current or voltage is applied. A further advantage is the high degree of flexibility in terms of configuration. Thus, the lighting system according to the invention allows in a simple manner the arrangement of several lighting units to form a (two-dimensionally or three-dimensionally) designed network which can optionally have several power supply units. The electrical connection is always via the connection of the lighting units so that many lighting units can be operated with just one single power supply unit or mains adapter. However, in principle several power supplier units can be connected at various points to the lighting system or two- or three-dimensional network or structure.

A two-dimensionally designed lighting system is take to mean one in which all the lighting units and connectors of the lighting system lie in one plane. This includes lighting systems which are linear, i.e. form a strip extending between two ends (connector followed by a lighting unit, in turn followed by a connector etc.) or lighting systems in the form of a circle, triangle or rectangle. Here, the lighting units and connectors can exclusively be arranged on the contour of the circle, triangle or rectangle, or further lighting units and/or connectors can also traverse the circle, triangle or rectangle and thus form a two-dimensional structure.

A three-dimensional lighting system is one in which individual or several lighting units and/or connectors are arranged on different planes from other lighting units and/or connectors and/or are arranged at angles to other lighting units and/or connectors. In other words spatial structures of lighting units and connectors are formed.

Some examples of embodiment of the lighting system according to the invention, which are also the subject matter of the dependent claims, will now be described below:

According to one embodiment at least one connector or, more particularly, several connectors are each mechanically and electrically connected to several lighting units.

According to another embodiment it is envisaged that the lighting system has at least two ends, in particular precisely two ends, and a connecting element is mechanically and electrically connected to the light segment at at least one of the ends, in particular at both ends, preferably at all ends. Accordingly, if the light segment is triangular, for example, this has three ends (the corners are defined as ends here). If the light segment is rectangular and can be connected to a connector at each of the four corners, the light segment then has four ends. Individual or all lighting units can thus have any number of connecting elements, triangular lighting units having three connecting elements for example, wherein one can be provided at each corner of the light segment in question. However, it is stressed that the connecting elements do not necessarily have to be provided at the corners or edges of the relevant light segment but can also be arranged at other points.

According to yet another embodiment the circumferential element is an element which is rotation-symmetrically circumferential (which surrounds the connector middle axis). The circumferential element then has a circular or ring shape in relation to a section perpendicular to the connector middle axis. If the connector has several circumferential elements or body sections, which will explained in more detail below, several or all circumferential elements can be formed in a rotation-symmetrical manner (around the connector middle axis).

According to a further embodiment it is envisaged that with the connector the lighting unit can be arranged in any position around the connector middle axis over a continuous (i.e. uninterrupted) angular range of at least 330°, preferably at least 340°, particularly preferably at least 355°. It is also conceivable that with the connector the lighting unit can be arranged in any position around the connector middle axis over several continuous angular ranges of in total at least 330°, preferably of in total at least 340° and particularly preferably of in total at least 355°. If, for example, it is envisaged that with the connector the lighting unit can be arranged in any position around the connector middle axis over two continuous angular ranges, each continuous angular range can comprise at least 165°, preferably at least 170°, particularly preferably 177.5°.

According to a further embodiment of the lighting system according to the invention it is envisaged that the connecting element can be pivoted relative to the lighting segment and/or the connector about a pivoting axis which extends at an angle, more particularly at right angles, or in parallel to the connector middle axis and, in particular, is at a distance from the connector middle axis. In the case of such pivotability the maximum pivoting range (angle about which pivoting can take place about the pivoting axis) is, in particular, at least 90°, preferably at least 180°, particularly preferably at least 270°. Alternatively or additionally it can be envisaged that the connecting element can be rotated relative to the lighting segment and/or relative to the connector about an axis of rotation which runs at an angle, more particularly at right angles, to the connector middle axis and intersects the connector middle axis.

According to a further embodiment it is envisaged that the connector is a multiple-part body comprising several body sections (body parts) circumferentially surrounding the connector middle axis, wherein the body section are arranged axially next to each other with some body section in contact with each other or axially spaced with regard to each other.

In accordance with another embodiment of the lighting system it is envisaged that the connecting element is positively and/or non-positively connected to the circumferential element, in particular pushed together (plug-type connection). In this case it is conceivable that the connecting element and the circumferential element are configured or designed in such a way that the connecting element can be fitted to the circumferential element through a translational movement at an angle, in particular at right angles, or in parallel to the connector middle axis and/or through a pivoting movement about axis which is at an angle, in particular at right angles, or parallel to the connector middle axis.

According to yet another embodiment the connecting element is bonded or connected to the circumferential element in one piece. Connected in one piece means that the parts connected to each other are integrally formed, i.e. formed/produced from one piece. In this case too it is fundamentally also conceivable that pivoting can take place between the connecting element and the circumferential element, e.g. if an elastic material is used for the one-piece component.

According to a further embodiment each body section (if several body sections forming the connector are present) forms a circumferential element, more particularly a rotation-symmetrical circumferential element, of the connector. Here, as will be described below, the body sections can have different cross-sections (with regard to a section perpendicular to the connector middle axis). In particular it is conceivable that several body sections/circumferential elements are fitted together in the axial directions, wherein each body section is mechanically and electrically connected, more particularly in one piece, to a connecting element of a lighting unit.

In the optional case that each body section is connected to a connecting element, it is conceivable that some or all the body sections have a plug on the upper side, more particularly centrally or co-axially to the connector middle axis, and a corresponding socket on the lower side or vice-versa (socket on the top and corresponding plug on the bottom).

The sockets and plugs are then configured in such a way that when fitted together a mechanical and electrical connection is formed between the plug and the socket and thus between the fitted together body sections/circumferential elements. The plugs and sockets can be configured in such a way that that when fitted together the body sections can be turned relative to each other about the connector middle axis. Additionally, in the body sections or in the plug and/or sockets, magnets or magnetic sections can be provided by means of which a magnetic attraction force is produced in the axial direction (direction of the connector middle axis) which improves and/or strengthens the connection between the fitted together body sections.

According to yet another embodiment of the lighting system according to the invention, it is envisaged that the connector has at least two axially spaced first body sections which circumferentially surround the connector middle axis and which have a first (relatively large) cross-section or diameter, and second body section, connecting the body sections (pin or sleeve-shaped for example) circumferentially surrounding the connector middle axis, with a second cross-section or diameter which is smaller than the first cross-section or diameter. In this case it is conceivable that at least one of the first body sections is detachably connected, more particularly pushed or screwed together, with the second body section. It is also conceivable that at least one (in particular another one) of the first body sections is connected to the second body section one piece or in a bonded manner.

According to a further embodiment it is envisaged that the connecting element has an opening, in particular a bored hole, wherein the cross-section or diameter of the opening corresponds in particular to the cross-section or diameter of the second body section.

According to another embodiment of the lighting system according to the invention it is envisaged that the connector has at least one first body section which circumferentially surrounds the connector middle axis and has a first (relatively large) cross-section or diameter, and, at a radial distance therefrom, at least one second body section which circumferentially surrounds the connector middle axis and has a cross-section or diameter which is smaller than the first cross-section or diameter, wherein the first body section is mechanically connected to the second body section, more particularly in one piece or in a bonded manner. The connection between the first and the second body section can take place, for example, by way of one or more webs, in particular radially extending webs. In particular it is conceivable that the inner contour of the first body section and the outer contour of the second body section are circular wherein in particular the first body section is of an annular shape and the second body section of an annular or disk shape. It is preferable if the connecting element is in contact with inner contour of the first body section and the outer counter of the second body section.

According to a further embodiment of the lighting system according to the invention it is envisaged that at least one connector, more particularly several connectors, has/have a separate (i.e. not electrically connected to one of the lighting units and/or one of the lighting segments) electrical input/output, more especially in the form of a connecting element, particularly in the form of a plug or a socket. An electrical input can, for example, be used to supply power to a (relatively large) lighting system at various points. An electrical output can be used, for example, to connect external consumers (electric consumers), for example, sensors, spots or similar. Power connectors or electrical devices, e.g. music systems or chargers for smart phones, computers etc. can be connected and supplied with electricity here. With this lighting system according to the invention these external consumers can be supplied with voltage and the voltage can be safely maintained. The sensors named as an example can also correspond (be electrically connected to) the lighting system or to individual lighting units of the lighting system, wherein sensors can include movement sensors, brightness sensors, smoke detectors, light barriers or suchlike.

According to one embodiment the above object is also achieved by a lighting system

- with at least one lighting unit (more particularly track) comprising a lighting segment (lighting element) (more particularly extending from a first end to a second end along a longitudinal axis of a lighting segment) which is configured for receiving at least one lamp or has at least one lamp, and at least one connecting element (in particular a plug or socket) (more particularly extending from a first end to a second end along a longitudinal axis of a connecting element) which at least in sections is electrically conductive or has at least one electrical conductor and at one of the two ends of the lighting segment is mechanically and electrically connected thereto, wherein preferably such a connecting element is mechanically and electrically connected to each end of the lighting segment,
- with at least one connector (also known as a nodal point) which has an element circumferentially surrounding a connector middle axis in a rotation-symmetrical manner and at least one electrical conductor mechanically connected with the circumferential element,
- wherein the connecting element of the lighting unit can be fitted together with the circumferential element of the connector, in particular in a connecting direction (pushing together direction), whereby the at least one lighting unit can be mechanically and electrically connected to the connector, i.e. the connecting element of the lighting unit and the circumferential element are formed as complementary elements of a plug-type connection,
- wherein with the connector the lighting unit can be arranged in any position (angular position) around the connector middle axis and in every position the lighting unit is mechanically and electrically connected to the connector and
- wherein the connecting element can be pivoted relative to the lighting segment, i.e. the longitudinal axis of the lighting segment can be pivoted relative to the longitudinal axis of the connecting element or the angle between the longitudinal axis of the lighting element and the longitudinal axis of the connecting element can be changed.

It should be pointed out that the lighting segment does not necessarily have to have a lamp, but must only be suitable for being able to receive at least one lamp. Lamps are, in particular, gas discharge lamps, light diodes and/or incandescent bulbs. If the lighting segment does not have any lamps, the lighting segment involves a lamp profile, for example an aluminium profile into which at least one of said lamps can be inserted.

According to the invention it is particularly envisaged that in the assembled state of the lighting unit and connector the connecting element can be pivoted relative to the lighting segment in a plane in which the connector middle axis extends.

According to one embodiment of the invention it is envisaged that the lighting unit, more particularly the lighting segment and/or connecting element, is at least in parts, preferably fully, made of a flexible material.

According to a further embodiment it is envisaged that the connecting element is mechanically connected to the lighting segment via a joint, e.g. a hinge (in particular a rotating joint with one degree of freedom). In this way, in the assembled state of the lighting unit and connector pivotability is achieved in the plane in which the connector middle axis extends.

It is also conceivable that the connecting element is connected to the lighting segment in one piece (integrally or produced from one piece), i.e. no joint/hinge is provided.

According to another embodiment it is envisaged that the connecting element 2*d* of the lighting unit and the circumferential element of the connector can be positively and/or non-positively connected to each other. In the assembled state the positive or non-positive connection is, in particular, contrary to the direction of fitting together.

In accordance with the invention it is particularly conceivable that the connecting element of the lighting unit, in particular the at least one electrical conductor of the connecting element, and the at least one electrical conductor of the connector each has a contact surface, wherein the contact surfaces are in contact with each other (are connected to each other) in the assembled state of the lighting unit and connector.

According to another embodiment the plug-type connection between the lighting unit and connector is detachable. Through breaking this mechanical connection the electrical connection is broken at the same time, i.e. the contact surfaces are moved away from each other.

According to further embodiments it can be envisaged that

- the connector(s) convey(s) current and the lighting unit(s) convey(s) current and/or
- the connectors(s) has/have an imaginary middle axis (connector axis) and bodies circumferentially surrounding the middle axis on which on or more lighting units can be attached and/or
- the lighting units(s) is/are suitable to receiving lamps and/or
- the connector(s) have several body sections circumferentially surrounding the middle axis which are axially spaced with regard to each other and can come into contact with the lighting unit(s) and are suitable for conveying current and/or
- the connector(s) has/have one or more elements which circumferentially surround the middle axis and into which connecting elements (plugs) of the lighting unit can be inserted or around which the clamp-shaped connecting elements of the lighting unit can be clamped and/or
- in the area of the lighting unit there are one or more joints or hinges which allows pivoting movement about an angle of 90°.

A nodal point, at which lighting tracks can be attached around a middle axis at any angle, opens up diverse two-dimensional design possibilities (FIG. 10). Joints on the lighting units or around the nodal points open up the world of three-dimensional design (FIG. 8 and FIG. 9). Simple and rapid connection of the rods in the nodal points facilitates experimental designing with these elements. Supplying power in the lighting units from nodal point to nodal point allows large means that larger structure with few power input points can be produced.

BRIEF DESCRIPTION OF THE DRAWINGS

Various features of the present invention will be defined below and explained by way of the illustrations, where.

DETAILED DESCRIPTION OF THE INVENTION

Nodal points, also known as connectors 1 or connecting points, in accordance with the present invention comprise in particular:

Elements with an imaginary middle axis (connector middle axis) 1*a* and a body or body section, circumferentially surrounding the middle axis 1*c*, e.g. in the form of a circular plate. "Circumferential" in the present invention is taken in particular to means a circular, i.e. "circularly circumferential".

Around the middle axis lighting units 2 can be attached through insertion, clamping or similar.

The lighting units can be attached at the nodal points at any angle. The only restriction is that the width of the lighting units does not allow an infinite number of connections.

The connectors, via electrical conductors 1*b*, convey current from the attached lighting units to other attached lighting units (at least two poles, e.g. low-voltage DC current).

OTHER EMBODIMENTS

Special connectors 3 provide fastening possibilities for mounting on a wall or ceiling. Additionally or alternatively connectors 4 are also conceivable which provided the possibility of feeding power into the system.

The connectors can also provide fastenings for further lighting units outside the body or body section circumferentially surrounding the middle axis.

Connectors can be connected with other connectors so that more lighting units can be attached.

Connectors can also be illuminated (include a lamp).

Tracks, also known as lighting units, according to the present invention are, in particular:

Elements which are suitable for structurally connecting connectors and conveying current. Preferably they are illuminated (e.g. aluminium profiles 2*b* with inserted LED strips).

Further Embodiments

The lighting units can also be flat and connect three or more connectors. The corners then form the ends with which the connectors are connected.

Some or all of the lighting units can also be unlit, i.e. have no lamps.

The lighting units are also suitable for only being connected at one nodal point.

Joints, in particular hinges or rotating joints, according to the present invention are, in particular:

Elements which allow a movement at an angle of 90° to the body or body section circumferentially surrounding the middle axis (definition of nodal point).

Figure 1:
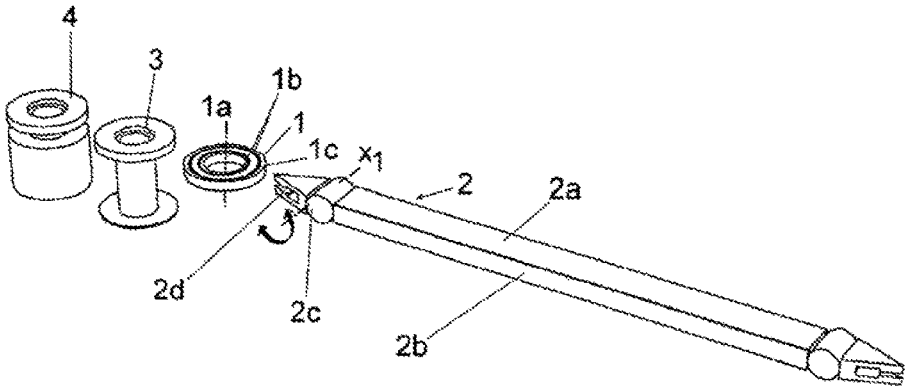
- FIG. 1 shows a perspective view of a lighting unit and various connectors.

Conceivable is a classic hinge at the end of the lighting units between a lighting segment (e.g. LED strip in aluminium profile) and connecting element (FIG. 1).

Figure 2:
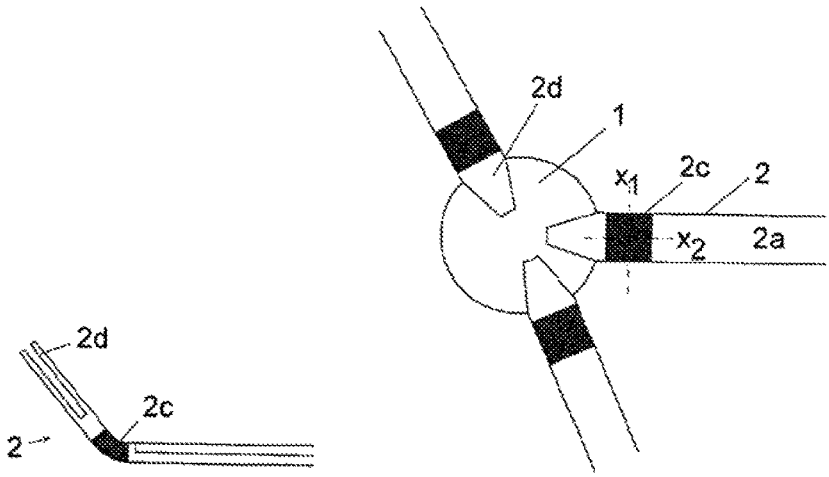
- FIG. 2 is a composite of two figures, one which shows a side view of the end portions of several lighting units and a connector, and the other of which shows a top view of the end portions of several lighting units and a connector.

Conceivable is a rubber element at one end of the lighting unit between a lighting segment and connecting element (FIG. 2 no. 2*c*). As an example, a pivoting axis $x_1$ and a rotation axis $x_2$ about which each lighting segment 2*a* can be pivoted or turned have been included in the drawing. The pivoting axis $x_1$ is entered in the plane of the drawing, so here extends in a plane perpendicular to the connector middle axis 1*a*. An alternative or additional pivoting axis $x_1$ can however also extend in parallel to the connector middle axis 1*a* and thus at right angles to the two axes $x_1$ and $x_2$ entered in FIG. 2.

Figure 7:
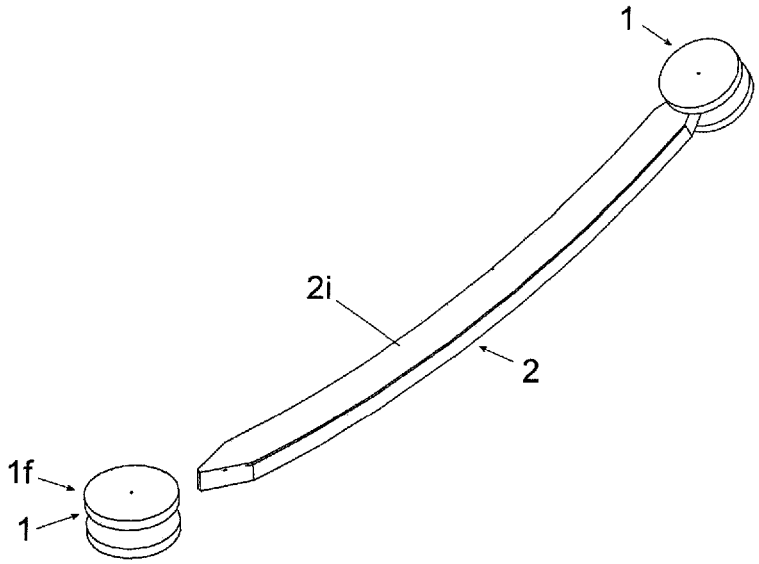
- FIG. 7 is a perspective view of a lighting unit having a connecter connected at one end and another connector spaced apart from the other end.
Figure 8:
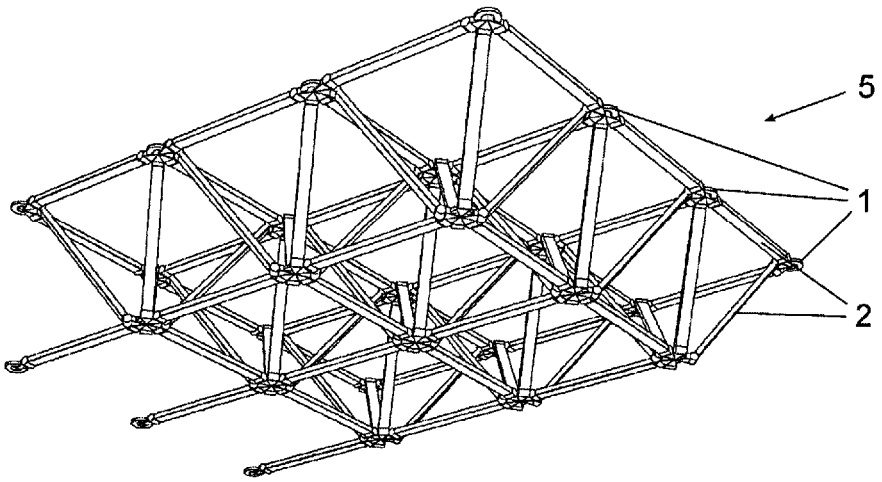
- FIG. 8 is a perspective view of another lighting system according to the invention.
Figure 9:
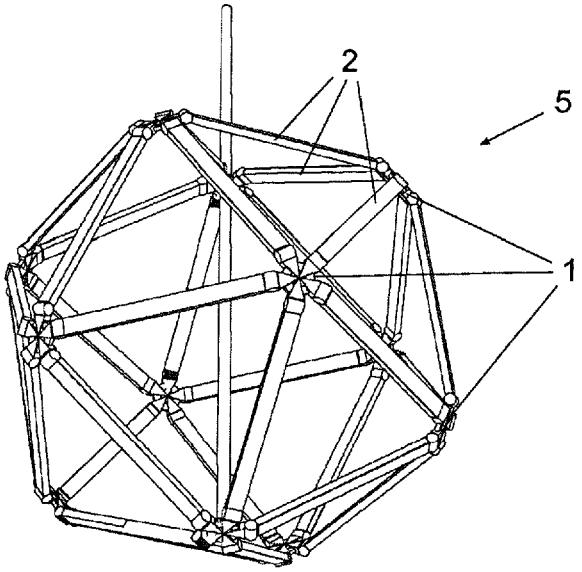
- FIG. 9 is a perspective view of another lighting system according to the invention.
Figure 10:
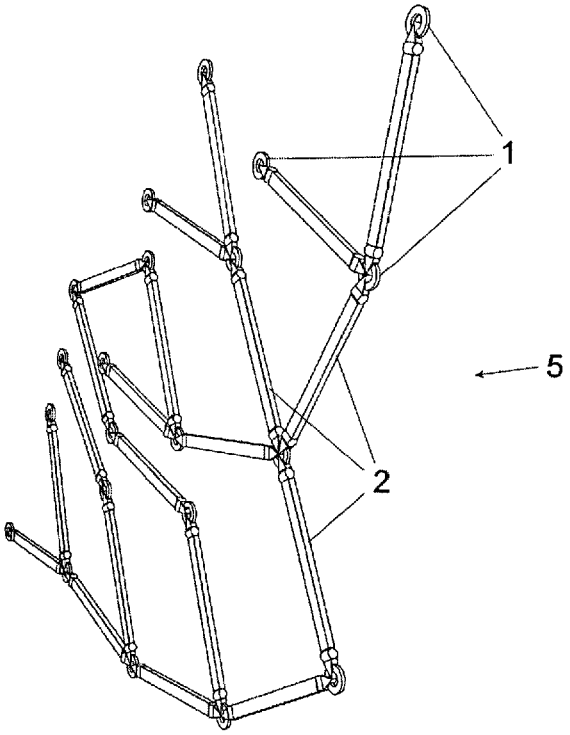
- FIG. 10 is a perspective view of another lighting systm accoriding to the invention.

It is conceivable that parts of or the entire lighting unit is made of a flexible material (thin wood, spring steel, alucobond) and thus the lighting unit or a section thereof is itself the joint (FIG. 7, no. 2).

It is conceivable that the connection between the nodal point and lighting units simultaneously forms the joint (e.g. the body or body section of the nodal point circumferentially surrounding the middle axis is formed by a round wire which is the axis for the joints at the same time).

In the following, embodiment are described and explained using the examples of embodiment set out in the figures.

According to a further embodiment it is envisaged that the lighting unit has a profile in which LED strips extend and the lighting system is operated at low voltage.

Accordingly, an advantageous embodiment of the invention is a low-voltage lamp with LED profiles. In the low-voltage range there is no danger to the user to that the required precautionary measures are not as great, as a result of which the design work is more straightforward. An obvious outcome of this is illumination by LED strips. A further obvious consequence is the use of a profile which is not only suitable for structurally connecting connectors, but also for receiving a light scattering profile and provides space for LEDs and also additional space for parallel power supply.

According to a further embodiment it is envisaged that the hinge or the hinges is/are arranged at the ends of the lighting unit, between the lighting segment(s) and the connecting elements (plug or clamping elements).

The described hinges or joints (FIG. 1 no. 2*c*) are located just before the ends of the lighting units between the segment, that can generally be illuminated (FIG. 1 no. 2*b*) and the connecting elements (FIG. 1 no 2*d*) to the nodal point (plug/clamp/etc.). The joints can be traditional hinges or also be made of elastic material.

This embodiment moves the joint points close to the nodal point which is of advantage for the geometry of structures built of the lighting system. From a mechanical and design point of view it would be ideal if the lighting units could meet at one point. Through moving the joints to the nodal point this is almost achieved. (The forces of rods are dissipated without a moment if the rods meet at one point). A further advantage lies in the spatial separation of the different functions: fastening element, joint, lighting segment. This spatial separation simplifies technical development.

According to a further embodiment it is envisaged that for fastening the lighting unit(s) to the nodal point connecting elements (plugs) are arranged on the ends of the lighting unit which engage between elements on the nodal point which are axially spaced and circumferentially surround the middle axis.

Figure 3:
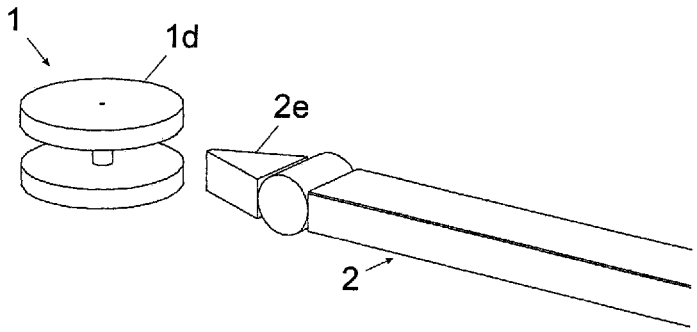
- FIG. 3 shows a perspective view of an end of a lighting unit and a connector.

Accordingly a plug-type connection is described (FIG. 3) which clearly defines the position of the plug axially with regard to the nodal point but radially permits any angle. Between two or more radial elements (FIG. 3 no. 1*d*), such as, for example, disks or plates, the connecting element (plug) (FIG. 3, no. 2*e*) is attached to the end of the lighting units. In contrast to other plugs, this does not engage in one or more holes, but in one or more radial lighting units.

According to another embodiment it is envisaged that, for fastening the lighting unit or lighting units at the nodal point, a clamp-like connecting element is arranged at the ends of the lighting unit which engages around an element of the connector circumferentially surrounding the middle axis.

Figure 4:
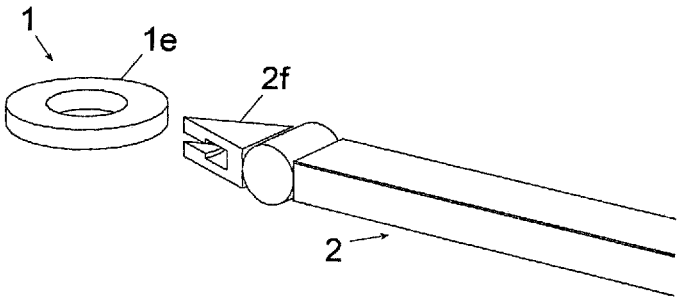
- FIG. 4 shows a perspective view of an end of a lighting unit and another embodiment of a connector.

A plug-type connection is accordingly described (FIG. 4) which has the inverse geometry, which is described in claim 9. A type of clamp (FIG. 4, no. 2*f*) grips one or more radial elements (FIG. 4, no. 1*e*) on the nodal point. Whereas in claim 9 the male component (plug) is on the lighting unit and the female component (socket) is on the nodal point, in claim 10 the female component (socket) is on the lighting unit and the male component (plug) on the nodal point. This results in the same advantages as in claim 9.

According to another embodiment it is envisaged that the connecting element (plug or clamp or clamp-like connecting element) has contacts with which power is transmitted from the nodal point.

Accordingly it is described that the electrical and structural connection are combined in the plug or clamp component. This simplifies the configuration of the lighting system as fewer interfaces have to be connected.

According to a further embodiment it is envisaged that at the nodal point at least one of the circumferential elements has an undercut into which the plug or around which the clamp (clamp-like connecting element) engages, wherein the plug/the clamp latches in the undercut(s).

Figure 5:
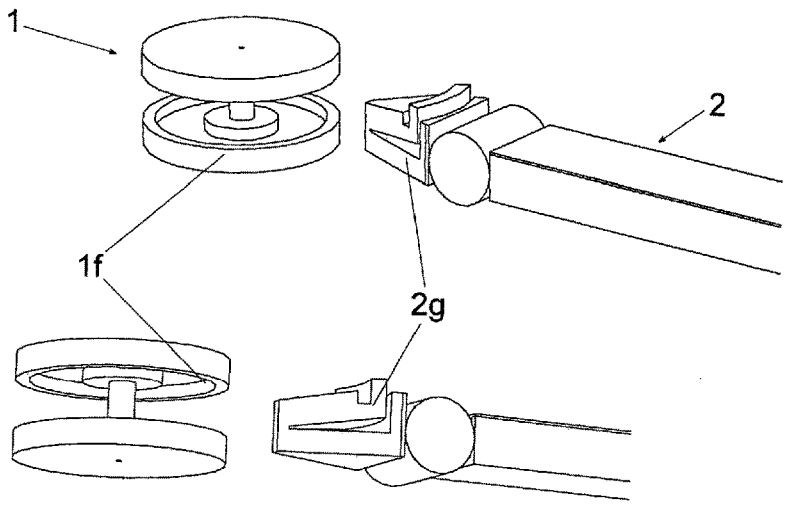
- FIG. 5 is a composite of two figures, oeach of which shows a perspective view of an end of a lighting unit and a connector.

Accordingly the connecting element at the end of the lighting units can snap into the nodal point. The nodal point has one or more radial elements which can be designed like a plate, a sleeve or a disk for instance. These elements have an undercut (FIG. 5, no. 1*f*), i.e. in outer area they have a circumferential brim, edge, bulge etc. The connecting element on the lighting unit is pushed from outside between or over one more radial elements and can engaged on the brim, edge etc. Expediently this connection is reversible. To undo the connection a button has to be pressed, for example, or a mechanical or magnetic force has to be overcome (FIG. 5 no. 2*g*).

According to a further embodiment it is envisaged that the connecting element has a ring which is suitable for pushing over the middle axis of the connector and, in particular, is firmly connected to the remainder of the connecting element.

Figure 6:
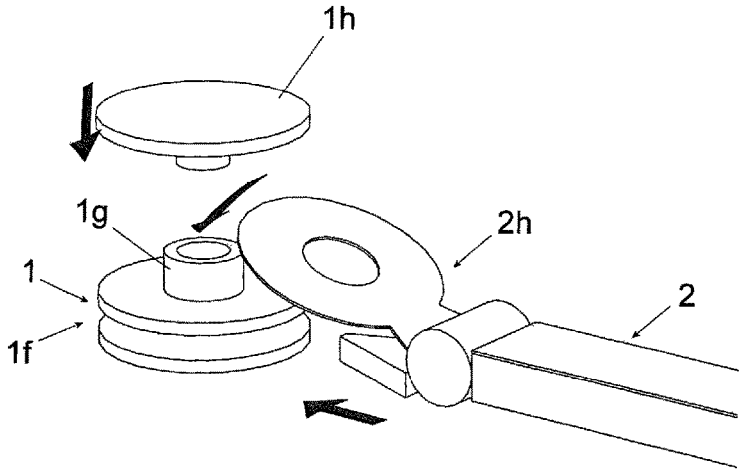
- FIG. 6 is a perspective view of a lighting unit having a connecter connected at one end and another connector spaced apart from the other end.

The connection element at the end of the lighting unit thus exclusively or additionally comprises a ring (FIG. 6, no. 2*h*). This ring can be fastened on the nodal point by being pushed over an axial (cylindrical) element (FIG. 6, no. 1*g*) on the nodal point, or in that an axial (cylindrical) element which forms part of the connector is pushed through the ring. The ring is so thin that several of these rings fit over the axial element. The most stable fastening to an axis can be achieved through encompassing of the axis. Orientation with regard to the axis is assured if a rod ends in an eye which encompasses the axis. In order to fasten several lighting units it is necessary for the ring to be flat and the axis long. (Length of the axis/thickness of the rings=number of rings that can be accommodated).

For fastening the ring is either placed over an axis or the axis is inserted into the rings. To prevent the rings sliding off the axis the axis can be reversibly provided with end caps (FIG. 6, no. 1*h*) which are larger than the inner diameter of the rings.

Advantageously, these rings can also be present in addition to the plugs/clamps described in claims 9 and 10. During assembly by the user, the clamps/plugs would then be fastened to the connectors and the rings then applied around a cylindrical, axial body. A securing element is then applied, if necessary, which prevents the ring from sliding out.

This method of connecting the nodal point and lighting units would have the advantage that the plug/clamp defines the axial stop, while the ring optimally aligns the light units to the axis and the plug/clamp prevents sliding out.

According to a further embodiment it is envisaged that the hinge is formed in that the lighting element comprises a flexible material 2*i* throughout, which is particularly suitable for being fully bent.

Through the use of flexible materials, such as, for example, spring steel, thin plywood, plastic material or alucobont, the flexibility can result in joints (FIG. 7. no. 2). It is conceivable that the material extends between the connectors like a bow (bow and arrow). The simple design would be advantageous.

According to a further embodiment it is envisaged that the connector(s) have fastening options which are suitable for supporting the lighting system and providing it with power.

The user is provided with the greatest number of design possibilities if connection to ceilings or walls takes place. The stability of this lighting system structure is also best when it is connected to connectors. Rationally, the power is also supplied through such connections.

These connections can be brought about via a wire or cable or a rod which ends in a flange etc.

Figure 11:
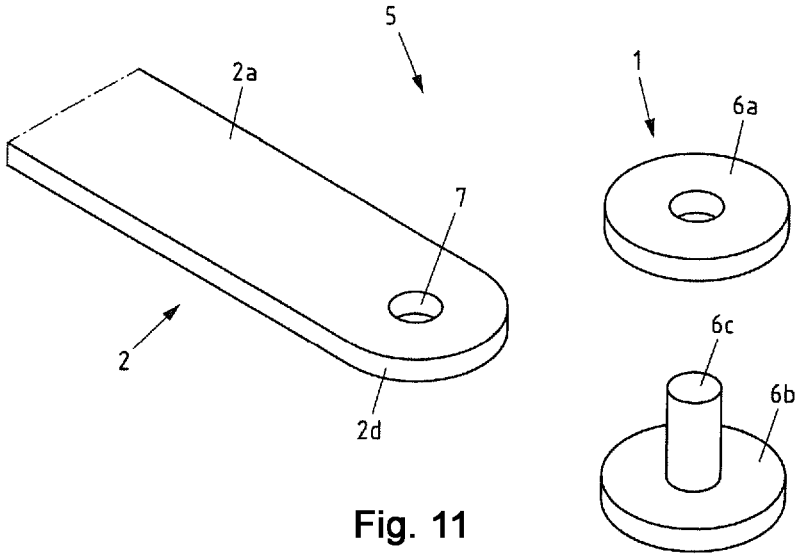
- FIG. 11 is a perspective view of an end of a lighting unit and a connector.

FIG. 11 shows a lighting system 5 in which the lighting units 2 each have a lighting segment 2*a*, for example in the form of profiles, which at the end visible in the figure are connected in one piece to a connecting element 2*d* in which an opening 7 in the form of a bored hole is provided. Via this bored hole 7 in the connecting element 2*d* several lighting elements 2 of the shown type can be placed in the axial direction on a two-part connection 1 and thereby fitted together. According to the example of embodiment in FIG. 11 the connector 1 has several body sections 6*a*, 6*b* and 6*c*, wherein the body sections 6*a* and 6*b* have a relatively large diameter and the stud-shaped body section 6*c* has a relatively small diameter. The body sections 6*b* and 6*c* are connected to each other in one piece and the body section 6*a*, after being connected together with several lighting units 2, can be mounted on body section 6*c*, e.g. screwed on, in order to fix the lighting units 2 on the connector 1 and to supply power/voltage via connector 1.

Figure 12:
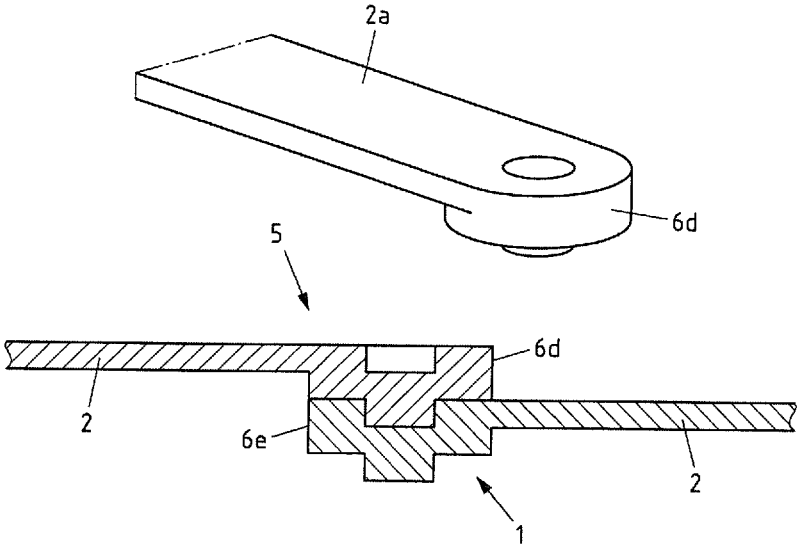
- FIG. 12 is a composite of two figures, one which shows a perspective view of end of a lighting unit and the other of which shows a section through ends of two joined lighting units.

FIG. 12 shows an example of embodiment in which the lighting units 2 each are designed in one piece with a circumferential element 6*d* or 6*e* of a connector 1. The connector 1 is formed in several pieces, i.e. it has several circumferential elements of body sections 6*d* and 6*e*. Each of the two shown body sections 6*d* and 6*e* has a recess (socket) on the upper side and on the lower side a projection (plug) that is complementary thereto, so that in the assembled state an electrical connection is present. In this example of embodiment the connector 1, or at least one part (body section) thereof, is connected in one piece with the relevant lighting unit 2. Although this is only shown for one end of the lighting unit, it can preferably also be provided on the other end(s) (not visible here) of the lighting unit 2.

Figure 13:
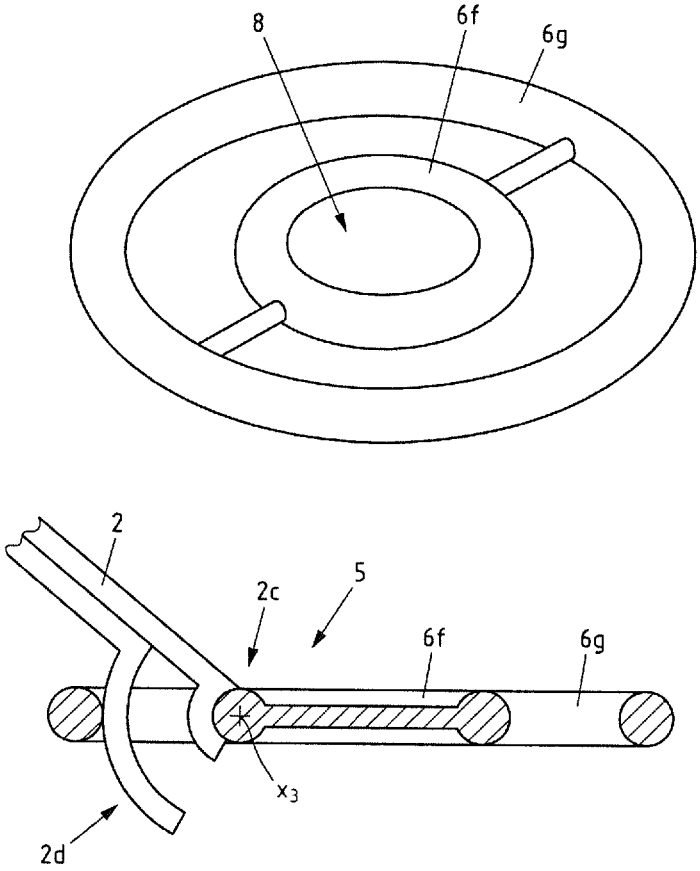
- FIG. 13 is a composite of two figures, one which shows a perspectiv view of a connecting element and one which shows a section taken through an end of a lighting unit and the connecting element.

FIG. 13 finally shows yet another example of embodiment in which the connector also has several (here, for example, two) circumferential elements or body sections 6*f* and 6*g*, which in this case lie in each other or in a common plane and are arranged concentrically with regard to each other (at a constant spacing with regard to each other). The inner, in this case disk-like, body section 6*f* has a smaller cross-section than the outer ring-like body section 6*g*. The body sections 6*g* and 6*f* are connected to each other via two webs which are diametrically opposite each other. With the connector the lighting unit 2 can be arranged at any position around the connector middle axis 1*a* in the angular range from one web to the other web around the connector middle axis 1*a*. Each of the two continuous angular ranges is around 175° for example.

The example of embodiment in FIG. 13 is also characterised by the special shape of the connecting element 2*d* of the lighting unit 2. The connecting element 2*d* is formed in such a way that the lighting element 2 can be connected to the connector through a pivoting movement about the axis $x_3$, wherein the pivoting movement takes place in a plane through which the connector middle axis 1*a* also extends or which runs parallel to the connector middle axis 1*a*. The lighting unit 2 is then held in the combined state in which there is a mechanical and electrical connection to the connector through gravity and/or an optional clamping force.

For the electrical connection in the case of the example of embodiment in FIG. 13 the curved sections of the connecting element 2*d*, which here are part of a joint, can convey or conduct electricity. Also electrically conductive are the body sections 6*g* and 6*f*, at least in the area of the inner contour of the body section 6*g* and the outer contour of body section 6*f*.

Finally it can also be seen in FIG. 13 that the body section 6*f* is here formed, as an example, as a plate with a bulge-shaped edge, wherein on the upper side and/or lower side the plate can have an electrical input and/or output 8 via which electricity can be supplied or external consumers provided with current/voltage.

The invention claimed is:

1. A lighting system comprising:

at least one lighting unit comprising a light segment which is configured for receiving at least one lamp or comprises at least one lamp, and at least two connecting elements that at least in sections are electrically conductive and are mechanically and electrically connected to ends of the light segment; and at least one connector, which has at least one element circumferentially surrounding a connector middle axis and at least one electrical conductor mechanically connected to or formed by the circumferential element;

wherein respectively one of the connecting elements of the lighting unit is mechanically connected to the circumferential element of the connector and thereby the at least one lighting unit is mechanically and electrically connected to the connector, wherein with the connector the lighting unit is arrangeable in various positions around the connector middle axis and in every position the lighting unit is mechanically and electrically connected to the connector, wherein several lighting units are mechanically and electrically connected to a common connector, and wherein angles in which the respective several lighting units are fitted to the common connector are largely freely selectable over a continuous angular range of at least 330° or over several continuous angular ranges of in total at least 330° around the connector middle axis.

2. The lighting system according to claim 1, wherein several connectors are each mechanically and electrically connected to several lighting units.

3. The lighting system according to claim 1, wherein the lighting system has precisely two ends, and a connecting element is mechanically and electrically connected to the light segment at both ends.

4. The lighting system according to claim 1, wherein the circumferentially surrounding element is a rotation-symmetrically circumferentially surrounding element.

5. The lighting system according to claim 1, wherein with the connector the lighting unit is arrangeable in any position around the connector middle axis over a continuous angular range of at least 340°, or over several continuous angular ranges of in total at least 340°.

6. The lighting system according to claim 1, wherein the connecting element is pivotable relative to the light segment and/or relative to the connector about a pivoting axis which extends at an angle or in parallel to the connector middle axis and is at a distance from the connector middle axis, and/or is turnable about a rotation axis which runs at an angle to the connector middle axis and intersects the connector middle axis.

7. The lighting system according to claim 6, wherein the maximum pivoting range is at least 90°.

8. The lighting system according to claim 1, wherein the connector is a multiple-piece body comprising several body sections circumferentially surrounding the connector middle axis wherein the body sections are arranged axially next to each other, and wherein some of the body sections are in contact with each other or are axially spaced with regard to each other.

9. The lighting system according to claim 8, wherein each body section forms a rotation-symmetrically circumferential element of the connector.

10. The lighting system according to claim 9, wherein several body sections are fitted together in an axial direction.

11. The lighting system according to claim 8, wherein the connector has at least two axially spaced first body sections which circumferentially surround the connector middle axis and which have a first cross-section or diameter, and a second body section, connecting the body sections circumferentially surrounding the connector middle axis, with a second cross-section or diameter which is smaller than the first cross-section or diameter.

12. The lighting system according to claim 11, wherein at least one of the first body sections is detachably connected, with the second body section and/or at least one of the first body sections being connected to the second body section in one piece or in a bonded manner.

13. The lighting system according to claim 8, wherein the connecting element has an opening wherein the cross-section or diameter of the opening corresponds to the cross-section or diameter of the second body section.

14. The lighting system according to claim 8, wherein the connector has at least one first body section which circumferentially surrounds the connector middle axis and has a first cross-section or diameter, and, at a radial distance therefrom, at least one second body section which circumferentially surrounds the connector middle axis and has a cross-section or diameter which is smaller than the first cross-section or diameter, wherein the first body section is mechanically connected to the second body section in one piece or in a bonded manner.

15. The lighting system according to claim 14, wherein an inner contour of the first body section and an outer contour of the second body section are circular, and wherein the first body section has an annular shape and the second body section has an annular or disk shape.

16. The lighting system according to claim 15, wherein the connecting element is in contact with the inner contour of the first body section and the outer contour of the second body section.

17. The lighting system according to claim 1, wherein the connecting element is positively and/or non-positively connected to the circumferential element.

18. The lighting system according to claim 17, wherein the connecting element is configured to fit together with the circumferential element through a translational movement at an angle or in parallel to the connector middle axis and/or through a pivoting movement about an axis which is at an angle or parallel to the connector middle axis.

19. The lighting system according to claim 1, wherein the connecting element is connected to the circumferential element in a bonded manner or the connecting element and the circumferential element are one unitary piece.

20. The lighting system according to claim 1, wherein at least one connector has a separate electrical input and/or output.

21. The lighting system according to claim 1, wherein the light segment and/or connecting element is at least in sections made of a flexible material.

22. The lighting system according to claim 1, wherein the connecting element is mechanically connected with the light segment via a joint.

23. The lighting system according to claim 22, wherein in the area of the lighting unit there are joints, which allow a pivoting movement about an angle of 90°.

24. The lighting system according to claim 22, wherein the lighting unit has a profile in which LED strips extend and the lighting system is operated at low voltage.

25. The lighting system according to claim 22, wherein the joint or joints are arranged at the ends of the lighting unit between the light segments and the connecting elements.

26. The lighting system according to claim 22, wherein the joint, is formed in that the lighting unit is entirely made of flexible material and is thus fully bendable.

27. The lighting system according to claim 1, wherein the connecting element is connected to the light segment.

28. The lighting system according to claim 1, wherein the connectors convey electricity and the lighting unit or lighting units convey electricity.

29. The lighting system according to claim 1, wherein the connectors have several body sections circumferentially surrounding the middle axis which are axially spaced with regard to each other and are configured to come into contact with the lighting unit or the lighting units and are suitable for conveying electricity.

30. The lighting system according to claim 1, wherein the connectors have one or more elements which circumferentially surround the middle axis and into which the connecting elements of the lighting unit can be inserted or about which clamp-like connecting elements of the lighting unit can be clamped.

31. The lighting system according to claim 1, wherein for fastening the lighting unit or lighting units to the connector, connecting elements are arranged at the ends of the lighting unit which engage between axially spaced elements on the connector circumferentially surrounding the middle axis.

32. The lighting system according to claim 1, wherein for fastening the lighting unit or lighting units to the connector, a clamp-like connecting element is arranged on the ends of the lighting element which clamps around an element of the connector circumferentially surrounding the middle axis.

33. The lighting system according to claim 1, wherein the connecting element has contacts with which electricity is transmitted from the connector.

34. The lighting system according to claim 1, wherein at least one of the circumferentially surrounding elements on the connector in or around which the connecting element engages has an undercut, and wherein the connecting element engages in the undercut.

35. The lighting system according to claim 1, wherein the connecting element has a ring configured to be pushed over the central axis of the connector.

36. The lighting system according to claim 1, wherein the connectors have a fastening option which is suitable for supporting the lighting system and supplying it with power.

37. A lighting system comprising:

at least one lighting unit comprising a light segment which is configured for receiving at least one lamp or comprises at least one lamp, and at least two connecting elements that at least in sections are electrically conductive and are mechanically and electrically connected to ends of the light segment; and at least one connector, which has at least one element circumferentially surrounding a connector middle axis and at least one electrical conductor mechanically connected to or formed by the circumferential element;

wherein respectively one of the connecting elements of the lighting unit is mechanically connected to the circumferential element of the connector and thereby the at least one lighting unit is mechanically and electrically connected to the connector, wherein with the connector the lighting unit is arrangeable in various positions around the connector middle axis and in every position the lighting unit is mechanically and electrically connected to the connector, wherein several connectors are mechanically and electrically connected to a common lighting unit, and wherein angles in which the lighting unit is fitted to the respective connectors are largely freely selectable over a continuous angular range of at least 330° or over several continuous angular ranges of in total at least 330° around the connector middle axis.

* * * * *